United States Patent [19]

Lucas

[11] 4,251,790

[45] Feb. 17, 1981

[54] MAGNETIC FOCUSING AND DEFLECTION SYSTEM FOR ELECTRON BEAM TUBES

[75] Inventor: Ilse Lucas, Munich, Fed. Rep. of Germany

[73] Assignee: Siemens Aktiengesellschaft, Berlin & Munich, Fed. Rep. of Germany

[21] Appl. No.: 15,462

[22] Filed: Feb. 26, 1979

[30] Foreign Application Priority Data

Mar. 15, 1978 [DE] Fed. Rep. of Germany ..... 2811265

[51] Int. Cl.[3] ..... H01H 100

[52] U.S. Cl. ..... 335/213; 315/10

[58] Field of Search ..... 335/213, 210; 315/10

[56] References Cited

U.S. PATENT DOCUMENTS 3,774,070 11/1973 Swart ..... 335/213

FOREIGN PATENT DOCUMENTS 2232793 1/1973 Fed. Rep. of Germany ..... 335/213
468965 11/1936 United Kingdom .

OTHER PUBLICATIONS

Proceedings of the I.R.E. "Electron Optics of Cylindrical Electric & Magnetic Fields" Jan., 1940–Albert Rose.

Proceedings of the I.R.E. "The Motion of Electrons Subject to Forces Tranverse to a Uniform Magnetic Field" Nov. 1947–Weimer & Rose.

RCA Review, "Electron Optics and Signal Readouts of High-Definition Return-Beam Vidicon Cameras" Mar. 1970–Ottoh. Schade, Sr.

"Handbook of Wireless Communications Technology" vol. 5, Television Technology, first part "Basics of Electronic TV" Berlin-Gott.-Heidelberg, 1956, pp. 582–612.

*Primary Examiner*—Harold Broome

*Attorney, Agent, or Firm*—Hill, Van Santen, Steadman, Chiara & Simpson

[57] ABSTRACT

A magnetic focusing/deflection system is disclosed for electron beam tubes, particularly camera tubes. The precessional motion occurring upon deflection of the beam which reduces the resolution toward the edge of the picture screen with increasing deflection angle is largely suppressed. The focusing-deflection system disclosed has a compact construction and has a deflection coil system provided for the beam deflection which is subdivided in such manner that a first set of deflection coils arranged on the beam source side and effecting the directional change of the beam emerging from the beam source and a second set of deflection coils arranged on the screen side and adapting the focusing field to the linearly extended beam direction of the beam emerging from the field of the first deflection coil pair are provided. A focusing coil is also provided which is spatially arranged completely on or largely superimposed on the second set of deflection coils.

7 Claims, 9 Drawing Figures

MAGNETIC FOCUSING AND DEFLECTION SYSTEM FOR ELECTRON BEAM TUBES

BACKGROUND OF THE INVENTION

The invention relates to a magnetic focusing/deflection system for electron beam tubes, particularly camera tubes, and wherein focusing and deflection coils are provided which are electrically independent of one another.

By means of the focusing properties of the electron optics of known electron beam tubes, particularly of camera tubes working according to the Vidicon principle, differences in the sharpness of an image to be written or, respectively, scanned can arise between the center and edge of the screen.

In the middle of the screen, the optics of the magnetic main lens in general do not limit the resolution, since other influences predominate. The attainable limiting resolution in the center of the screen is determined in camera tubes essentially by the noise limit of the succeeding amplifier which sets a lower limit per image element for the current transported by means of the electron beam and thus determines the size of the image element to be resolved with a given beam current density. As is known, the attainable beam current density is subject to thermodynamic laws and cannot lie above the emission density of the cathode in a collecting screen lying at cathode potential. The resolution attainable for the usual oxide cathode lies at about a radius of 10 $\mu$m for an image element and determines the resolution in the center of the screen. Upon deflection of the electron beam, additional electron-optical resolution errors ensue, the avoidance of which has, up to now, not been satisfactorily attained in systems with compact construction. For the possible focusing of a beam with a given strength, a thermodynamically established minimum cross-section is specified which cannot be fallen below without having a part of the electrons reverse.

Optical image errors of the imaging electron optic system only have a limiting effect on the resolution when they exceed the thermodynamically specified minimum cross-section of the beam. In the center of the screen, optical image errors are without influence upon retention of the rotational symmetry. However, the resolution is dependent to a high degree on deviations from the rotational symmetry which are conditioned by the manufacturing. At the edge of the screen, the imaging errors are amplified as a result of the precessional motion of the electron beam in the superimposed focus and deflection fields.

Attempts to attenuate the precessional motion were already undertaken at the beginning of the Vidicon development, cf. for example, Proceedings IRE 28, 1940, P. 30; Proceedings IRE 35, 1947, P. 1273 (Both incorporated herein by reference). Therefore, the influence of the field course in longitudinal direction was theoretically investigated and it was found that upon distribution of the rise and the decay of the deflection field over a respective full round-trip period in the main field, the precessional amplitude becomes very small. This perception was employed in the construction of a return-beam Vidicon with increased resolution, cf. RCA Review, March 1970, p. 60 ff (incorporated herein by reference). This known Vidicon is relatively elaborate, because four full round-trip movements of the focusing in the field of the main lens lie between aperture and screen, which requires a length of 28 cm for this path.

The existing problem, therefore, could up to now be solved only by means of a spatial separation of the focusing and of the deflecting field, which is effectually possible in image reproduction tubes, but not in camera tubes with compact construction, cf. also for example, "Handbook of Wireless Communications Technology", Volume 5, Television Technology, first part, "Basics of Electronic Television", BERLIN-GOTTINGEN-HEIDELBERG 1956, Pages 582–612, particularly Pages 583–584: "The Orthicon" (incorporated herein by reference).

SUMMARY OF THE INVENTION

An object of the present invention is to largely neutralize the decay of the electron optical resolution from the center of the screen towards the edge of the screen in electron beam tubes, particularly in camera tubes working according to the Vidicon principle, i.e. camera tubes that are compactly constructed.

The invention is based on the idea of dimensioning the magnetic deflection field in such manner that the central beam of the ray bundle proceeding from the aperture opening carries out no precessional motion upon deflection, but rather is conducted from the aperture opening to the edge of the picture screen along a path that is as short as possible.

A new way for attenuating the precessional amplitude is proposed in which the compactness of the arrangement is retained and, in all, no additional ampere-windings are required in comparison to known coil arrangements. The invention system works with fields in both transverse directions when the beam is to be deflected in a transverse direction.

This object is achieved by means of a magnetic focusing/deflection system as initially mentioned in which a first set of deflection coils is arranged on a beam source side of the tube for effecting a directional change of the beam emerging from the beam source. A second set of deflection coils is arranged on the screen or target side and being provided for adapting a focusing field to a linearly extended direction of the beam emerging from a field of the first set of deflection coils. An electrically independent focusing coil is spatially arranged either around or largely superimposed on or with the second set of deflection coils.

An advantage of the invention consists in that a sufficiently uniform resolution is rendered possible with a compact design of the system. A compactly constructed camera tube realized according to the invention with practically uniform resolution is suitable for incorporation into an easily manipulated television camera. On the basis of the said properties, such a television camera can be advantageously used, for example, together with suitable picture reproduction devices for the presentation of x-ray pictures which are poor in contrast and/or unclear per se.

DESCRIPTION OF THE PREFERRED EMBODIMENTS

Figure 1:
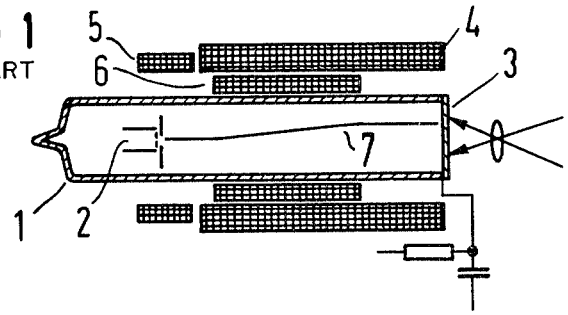
FIG 1 PRIOR ART
FIG. 1 shows the basic construction of a known Vidicon in longitudinal section.

As already explained, FIG. 1 shows the basic construction of a known Vidicon in longitudinal section. Accordingly, the electron beam tube is designated 1, the beam source 2, the screen 3, the focusing coil 4, the adjusting coil 5, the deflection coils 6 and the beam 7.

Figure 2:
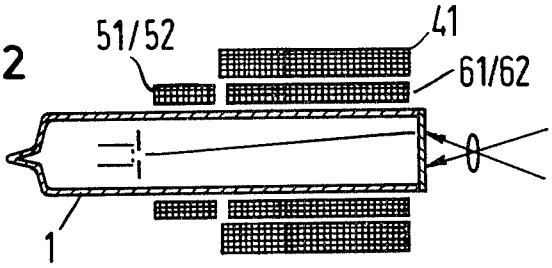
FIG. 2 shows in longitudinal section the basic construction of a sample embodiment for a Vidicon with the inventive focusing/deflection system.

In FIG. 2, as likewise already explained, the longitudinal section through the arrangement of the inventive focusing/deflection system of a sample embodiment is shown. According to the invention, a set of coils for the focusing and the deflection of the electron beam in both directions consists, in all, of a focusing coil 41 and four deflection coil pairs of which two are combined to a first set of deflection coils 51/52 and two are combined to a second set of deflection coils 61/62. The deflection coils lying closer to the aperture stop serve for the bending of the beam in the deflection direction, whereas the rear deflection coils serve for adapting the focusing main field to the altered beam direction. The compact construction is guaranteed by means of the spatial superposition of the second set of deflection coils 61/62 with the focusing coil 41.

Figure 3:
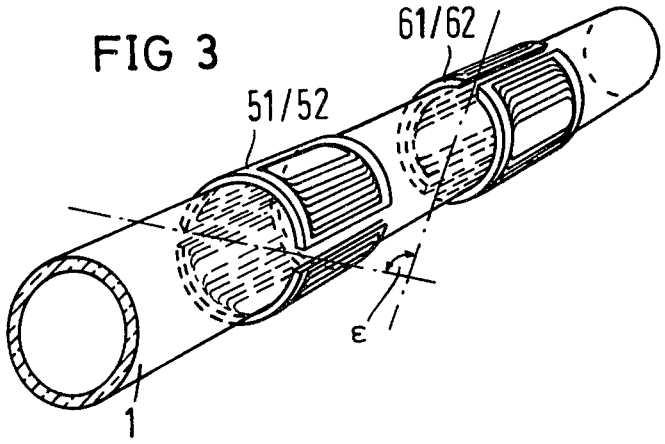
FIG. 3 shows the inventive arrangement in principle of a first and of a second pair of deflection coils which, for example, are provided for the deflection in the x-direction.

As already explained, FIG. 3 shows, in principle, the inventive arrangement of a first deflection coil pair 51/52 and a second deflection coil pair 61/62. The two deflection coil pairs are arranged on the envelope of the electron beam tube 1 turned with regard to one another by the angle $\epsilon$, whereby their field planes lie respectively twisted. Accordingly, the direction of the deflection field for the electrons passing through on the path from the aperture opening to the screen 3 is turned around the longitudinal axis z of the electron beam tube 1. The same effect can be achieved by means of a single coil pair with spiral-like winding.

Accordingly to the invention, the avoidance of deflection-conditioned focusing errors rests on an avoidance of the precessional motion of the center beam upon deflection. The focusing coil 41 generates a rotational-symmetrical magnetic field which images the plane of the aperture opening on the reception screen, cf. FIG. 4.

Figure 5:
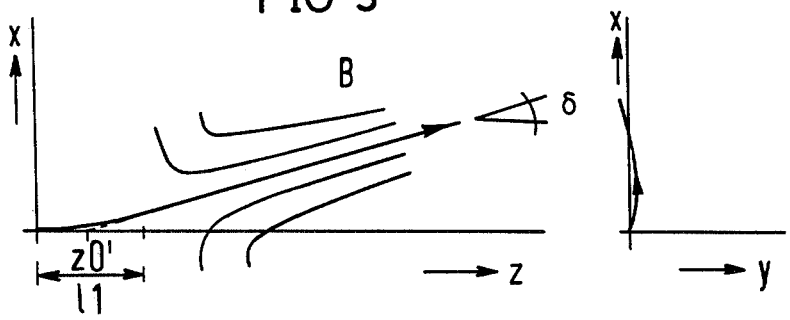
FIG. 5 qualitatively shows the desired course of the deflected path and the magnetic field inventively adapted to the path.

The optimum beam course shown in FIG. 5 consists of a short bent partial segment directly behind the aperture opening and a succeeding, longer, straight partial segment. The defocusing upon deflection stems solely from the bent partial segment. On the screen side, a second bent partial segment, which is not illustrated here, connects to the straight partial segment, arises because of the influence of a lander correction lens.

Figure 4:
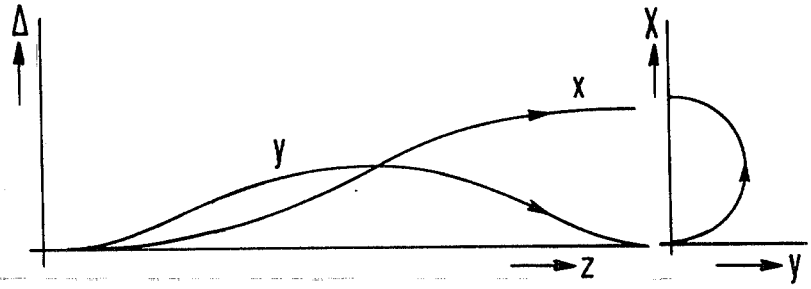
FIG 4 PRIOR ART
FIG. 4 qualitatively shows the deflection of the electron beam in the projection of its path on the longitudinal section plane xz or, respectively, yz (left) and on the cross-section plane xy (right) in a known Vidicon.
Figure 6:
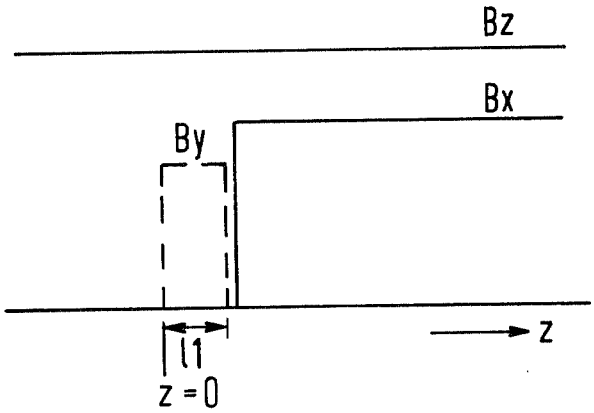
FIG. 6 qualitatively shows the idealized step-shaped field distribution By or, respectively, Bx and the homogeneous field Bz over the z-axis according to the desired path course shown in FIG. 5.

FIG. 4 qualitatively shows the course of the deflected electron beam in projection on the planes xz, yz and xy in a known Vidicon. The precessional amplitude can be particularly clearly seen in the xy-projection. For comparison, FIG. 5 shows a desired beam course without precession. Generally, a field can be easily provided which deflects the beam according to FIG. 5. If one allows step-shaped fields Bx, By, given a homogeneous field Bz in the z-direction, a field By which bends the beam in the x-direction is sufficient in the front section and, thereafter, a step-shaped field Bx which, together with the field Bz generates a homogeneous field in the beam direction, cf. FIG. 6.

The focusing error caused by the precessional motion can be exactly calculated given a homogeneous focus field and a homogeneous deflection field.

$$\Delta r = 2l\delta^2\alpha \tag{1}$$

is valid where:

$\Delta r$ is the radius of the image of a point $2l$ is the distance between the aperture stop and the screen $\delta$ is the deflection angle $\alpha$ is one-half the beam opening angle.

The error conditioned by precession in fields which are not homogeneous is of the same magnitude. In the inventive beam course without precession, the attainable focusing error can be ascertained on the basis of FIG. 9. In that FIG., a ray bundle ideally converging onto a point P is shown. How the beam union is represented is ascertained when, proceeding from the plane z=0, homogeneous deflection field By is present which bends the beam in the x-direction. Since all electrons in the beam have the same velocity, beginning from the plane $z=0$ the individual beams pass through circular orbits of the radius of curvature R, with $$\frac{1}{R} = \frac{m\,v}{q\,By} \tag{2}$$

There, m indicates the electron mass, q the electron charge.

The analytical expressions for the paths for the upper edge of the bundle are, in a first approximation:

$$x = x0 - z\tan\alpha + \frac{1}{2R}\,\frac{z^2}{\cos\alpha} \tag{3}$$

for the center axis of the bundle:

$$x = \frac{z^2}{2R} \tag{4}$$

for the lower edge of the bundle:

$$x = -x0 + z\tan\alpha + \frac{1}{2R}\,\frac{z^2}{\cos\alpha} \tag{5}$$

$2\times 0$ is the bundle diameter in the plane $z=0$.

Without a magnetic field, with $z=z1$, the beams would intersect with $$z1 = \frac{x0}{\tan \alpha} \quad (6).$$

With a magnetic field, the intercept of the two edge beams (3) and (5) lies laterally displaced at $z=z1$, $x=x1$ with $z1$ from (6) and $$x1 = \frac{z1^2\, 1}{2R \cos \alpha} \quad (7).$$

The deflection of the center beam at $z=z1$ amounts to $z1^2/2R$, so that a deviation between center beam and edges beams of $$\Delta x = \frac{z1^2}{2R} \left( \frac{1}{\cos \alpha} - 1 \right) \quad (8).$$

is present. Upon introduction of the direction change by means of $$\delta = \left( \frac{dx}{dz} \right)_{z=z1} = \frac{z1}{R} \quad (9)$$

(9) becomes $$\Delta x = z1 \frac{\alpha\, \alpha^2}{4} \quad (10).$$

With $\Delta x=2\Delta r$, $z1=l1$, one obtains $$\Delta r = \tfrac{1}{8} \delta \alpha^2 l1 \quad (11)$$

Figure 9:
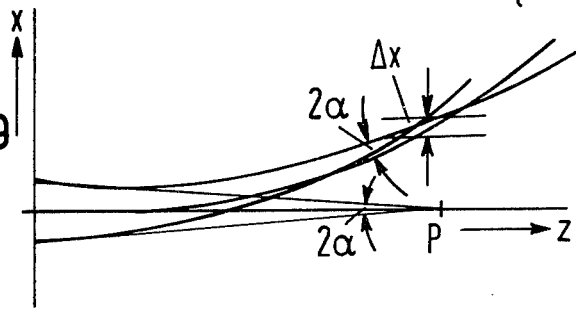
FIG. 9 qualitatively shows the course of the deflection of a ray bundle in the x-plane which is produced by means of a homogeneous field By beginning at z=0.

In FIG. 9, a beam is shown which is first focused and then deflected. It proceeds from the specification of the invention that the beam is first deflected and subsequently focused. The focusing errors are the same in both instances, since the eikonal differences from both parts add up. Accordingly, the sequence of the processes is immaterial.

As already shown further above, the characteristic diameter of the imaging of a point amounts to $$\Delta r = \tfrac{1}{8} \delta \alpha^2 l1 \quad (11),$$

where $l1$ is the length of the bent piece. The angle $\delta$ indicates the directional change of the beam. A division of (11) by (1) reveals an invention reduction of the focusing error by a factor $$F = \frac{1}{16} \; \frac{\alpha l1}{\delta\, l} \quad (12).$$

Typical values are $\alpha=1°$, $\delta=5°$, $l1/l<0.5$, so that it results $$F<0.006.$$

For a calculation of the course of the deflection fields, the following simplifying assumptions can be made:

1. The course of the focus field beyond the axis is derived solely from the course of the first derivation of the field on the axis.

2. The deflection fields are assumed as constant above the cross-section and thus depend solely on z.

From the focus field on the axis $$Bz = B(z) \quad (13)$$

with assumption 1., one obtains the appertaining radial component $$Br = -\frac{r}{2} B'(z) \quad (14).$$

where r is the distance from the axis.

Br and Bz are interrelated because of source freedom. Terms with $r^2 B''(z)$ and higher terms are neglected in (14). Expediently, step-shaped transverse fields Bx, By and a homogeneous longitudinal field Bz are taken as the basis for a first assessment of the size of the required deflection fields.

By approximation, a circular orbit in field By can be assumed in the front section of the path in FIG. 5. From its radius (v. (2)), one obtains the field By at $$By = \frac{mv}{ql1} \delta \quad (15).$$

In the step model, this field extends from $z=0$ to $z=l1$. The directional change is identical to the slope of the path at $z=l1$. The homogeneous field Bz must be rotated around the angle $\delta$ proceeding from $z=l1$ so that it is centrally traversed by the path. Therefore, a transverse field is required in the x-direction beginning at $z=l1$.

$$Bx = \delta B(z) \quad (16).$$

With a continuously variable transverse field By, (15) is to be replaced by $$\delta = \frac{q}{mv} \int_0^{l1} By\, dz \quad (17).$$

In addition to a rotation of the main field according to (16), a lateral displacement is necessary in order to fix the position of the axis of the rotated field. According to (14), the focus field can be displaced by a segment x0 in the x-direction by means of a transverse field $$Bx = \frac{x0}{2} B'(z) \quad (18)$$

The rotated axis in FIG. 5 satisfies the equation $$x = \delta \cdot (z - z0) \quad (19),$$

whereby $z=z0$ is the center of rotation. The transverse field in the x-direction consisting of rotation and displacement, according to (16) and (18) upon incorporation of (19) is $$Bx = \delta \cdot \left( B(z) + \frac{z - z0}{2} B'(z) \right) \quad (20).$$

This equation was used in a computer simulation of the path.

Figure 7:
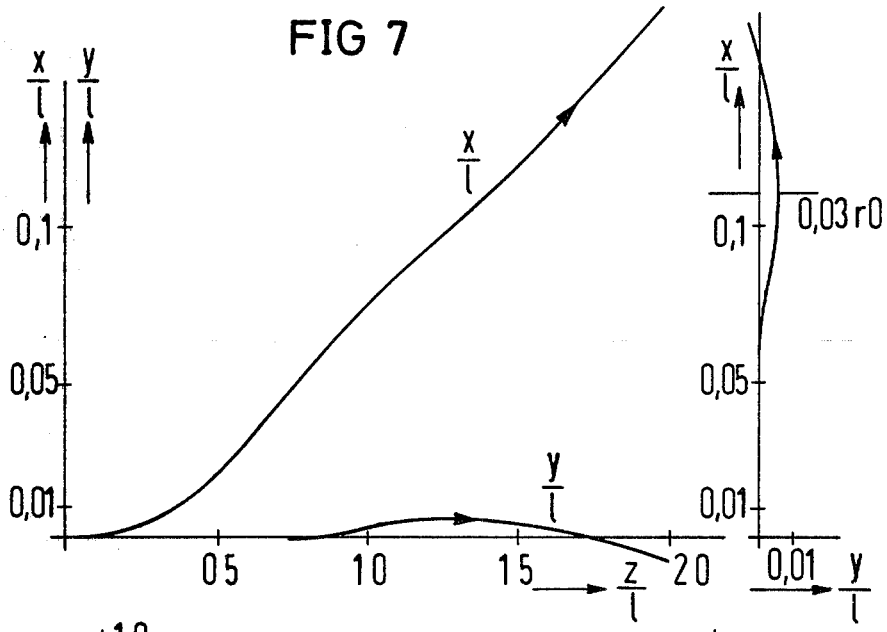
FIG. 7 quantitatively shows the deflection of the electron beam in the projection of its path on the longitudinal section plane xz or, respectively, yz (left) and on the cross-section plane xy (right) which was inventively ascertained by means of computer simulation.
Figure 8:
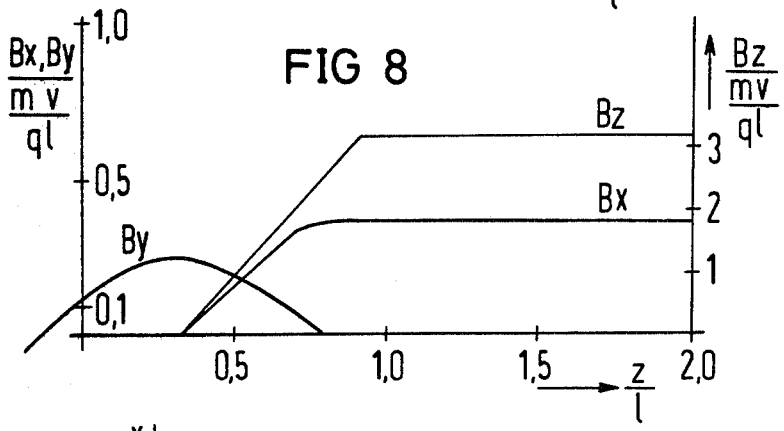
FIG. 8 quantitatively shows the field distribution Bx, By, Bz over the z-axis required for the deflection shown in FIG. 7.

The resulting solution illustrated in FIG. 7 proves to be nearly ideal. The corresponding magnetic fields are shown in FIG. 8. Please note the different scales on the left side for Bx, By and on the right side for Bz.

The use of an asymmetric field Bz which decays towards the left and is constant towards the right proves to be an aggravating condition for the compensation. If one also allows Bz to decay toward the right, then that quickly leads to solutions with very steep right-side flanks of Bx, whereby, upon certain conditions, negative values also occur. Such field paths cannot be realized.

The asymmetric field Bz illustrated in FIG. 8 is realizable and effects a linear reduction factor $M=0.645$ of the magnetic main lens.

According to FIG. 7, the beam strikes the screen obliquely. Because of the lack of an azimuth component upon striking, a correction of the radial striking direction by means of a lander correction lens according to Lubshinsky, cf. British Pat. No. 468,965 incorporated herein by reference, is advantageous.

The present invention is not restricted to use in electron beam tubes intended for image pick-up or, respectively, image reproduction. In another sample embodiment which is not illustrated, the inventive magnetic focusing/deflection system is provided in an electron beam scanning microscope. The compact construction rendered possible by means of the invention allows the use of a relatively small vacuum container with a correspondingly small membrane surface, whereby a more advantageous degasification process is yielded.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A magnetic focusing and deflection system for beam deflection in electron beam tubes, comprising: a beam source means for emitting an electron beam; a target positioned to receive the beam; a deflection coil system which is subdivided such that a first set of deflection coil means is arranged on a beam source means side of the tube for effecting a directional change of the beam emerging from the beam source means and a second set of deflection coil means is arranged on a target side for adapting a focusing field to a linearly extended direction of the beam emerging from a field of the first set of deflection coil means; and an electrically independent focusing coil means which is arranged around the second set of deflection coil means for producing said focusing field.

2. A magnetic focusing and deflection system according to claim 1, wherein the first set of deflection coil means and the second set of deflection coil means are arranged on an envelope of the electron beam tube such that their field planes lie twisted with regard to one another so that a direction of the deflection field for the electrons passing through on the way from the aperture opening of the beam source to the screen is turned around a longitudinal axis z of the electron beam tube.

3. A magnetic focusing and deflection system according to claim 2, wherein field planes of the first set of deflection coil means and of the second set of deflection coil means lie twisted by approximately 90° with respect to one another.

4. A magnetic focusing and deflection system according to claim 1, characterized in that the first set of deflection coil means and the second set of deflection coil means are united as a single coil pair distributed over an entire influencing length of the tube with a spiral-like winding effecting a desired field rotation.

5. A magnetic focusing and deflection system according to claim 1 wherein a magnetic lander correction lens means is provided arranged on the target side for correction of a striking angle between the beam and the target.

6. A magnetic focusing and deflection system according to claim 1 wherein the focusing coil means is largely superimposed on the second set of deflection coil means.

7. A magnetic focusing and deflection system for beam deflection in electron beam tubes, comprising: a beam source means for emitting an electron beam; an electrically independent focusing coil means for creating a focusing field; a first set of deflection coil means arranged adjacent the beam source means for effecting a directional change of the beam substantially where the beam emerges from the beam source means; a second set of deflection coil means laterally adjacent the first set and concentric with the focusing coil means and for adapting the focusing field to a linearly extending beam emerging from a field of the first set of deflection coil means.

* * * * *